United States Patent [19]

Braine et al.

[11] Patent Number: 4,964,248

[45] Date of Patent: Oct. 23, 1990

[54] COPING ASSEMBLY FOR A NON-UNIFORM PARAPET WALL

[75] Inventors: Mark D. Braine; Ralph Kirby; Donald W. Schultz, all of Asheville; Richard G. Tuttle, Hendersonville; Nelson M. Ferg; John B. Hickman, both of Asheville; William C. Webb, Arden, all of N.C.

[73] Assignee: W. P. Hickman Company, Asheville, N.C.

[21] Appl. No.: 470,326

[22] Filed: Jan. 25, 1990

[51] Int. Cl.[5] ..... E04D 3/38

[52] U.S. Cl. ..... 52/60; 52/96; 52/300

[58] Field of Search ..... 52/58, 60, 94, 96, 469, 52/300, 217

[56] References Cited

U.S. PATENT DOCUMENTS

| | | | |
|---|---|---|---|
| Re. 27,761 | 9/1973 | Attaway . | |
| 1,740,753 | 12/1929 | Vallas . | |
| 2,554,779 | 5/1951 | Goodwin . | |
| 2,734,602 | 2/1956 | Dawson . | |
| 2,855,776 | 10/1958 | Trostle . | |
| 2,920,477 | 1/1960 | Shaw . | |
| 3,012,376 | 12/1961 | Reddy et al. . | |
| 3,090,161 | 5/1963 | Edwards . | |
| 3,237,352 | 3/1966 | Edwards . | |
| 3,405,485 | 10/1968 | Edwards . | |
| 3,447,273 | 6/1969 | Thom . | |
| 3,696,575 | 10/1972 | Armstrong . | |
| 3,719,010 | 3/1973 | Hickman . | |
| 3,738,068 | 6/1973 | Attaway | 52/60 |
| 3,802,140 | 4/1974 | Hickman . | |
| 3,862,531 | 1/1975 | Attaway et al. | 52/58 X |
| 4,071,987 | 2/1978 | Hickman . | |
| 4,083,158 | 4/1978 | Wolma | 52/96 X |
| 4,472,913 | 9/1984 | Hickman . | |
| 4,483,112 | 11/1984 | Rueblinger | 52/58 X |
| 4,488,384 | 12/1984 | Hickman . | |
| 4,549,376 | 10/1985 | Hickman . | |
| 4,617,770 | 10/1986 | Hickman . | |
| 4,798,033 | 1/1989 | Weidl | 52/60 X |
| 4,858,406 | 8/1989 | Lane et al. | 52/300 |
| 4,860,689 | 1/1989 | Lane | 52/60 |
| 4,890,426 | 1/1990 | Hickman et al. | 52/58 |

FOREIGN PATENT DOCUMENTS

| | | |
|---|---|---|
| 2118981 | 10/1972 | Fed. Rep. of Germany . |
| 1104027 | 2/1968 | United Kingdom . |
| 1180965 | 2/1970 | United Kingdom . |
| 1347974 | 2/1974 | United Kingdom . |

OTHER PUBLICATIONS

Trion—Architectural Copings (Special Metals Division), 1 page.

C/S Colortrim Coping (Construction Specialties), 2 pages.

Overly Metal Coping (Overly Manufacturing Co., Los Angeles), 4 pages.

"Extruded Aluminum Gravel Stops and Copings"—Extruded Aluminum Coping Type, G—8, G—12, G—6, and G—11 (2 pages).

"Snap—Lok Coping", (MM Systems, Inc.), 1 page.

Drawing—Full Coping (Metal—Era, Inc., Wisconsin), 1 page.

*Primary Examiner*—John E. Murtagh
*Assistant Examiner*—Creighton Smith
*Attorney, Agent, or Firm*—Harness, Dickey & Pierce

[57] ABSTRACT

A coping assembly is disclosed for a parapet wall on a building structure that can accommodate varying or inconsistent wall widths, with the parapet wall having generally vertical inner and outer vertical surfaces interconnected by a generally horizontal upper surface. Coping assemblies according to the present invention include a preferred resilient clip member, a clip attachment device for attaching the clip member to the parapet wall, a fascia member, a top plate member, and a top plate anchoring device for anchoring the top plate to the parapet wall. The fascia member and the top plate member have overlapping or telescoping portions that provide for the feature by which various wall widths or thicknesses can be accommodated.

38 Claims, 3 Drawing Sheets

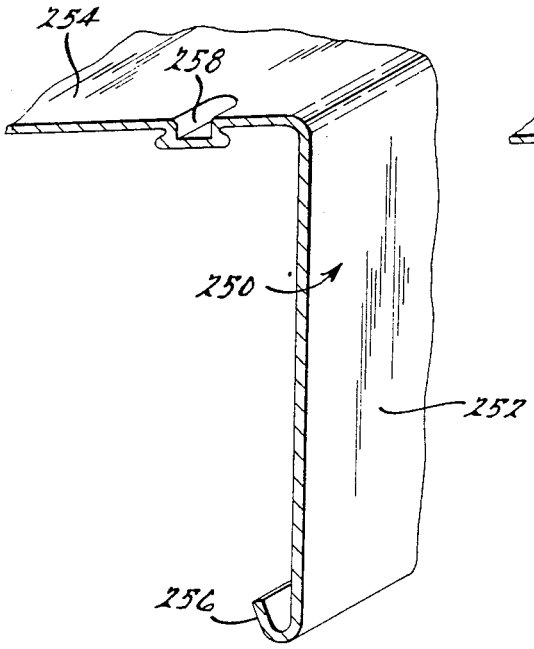
FIG. 3.
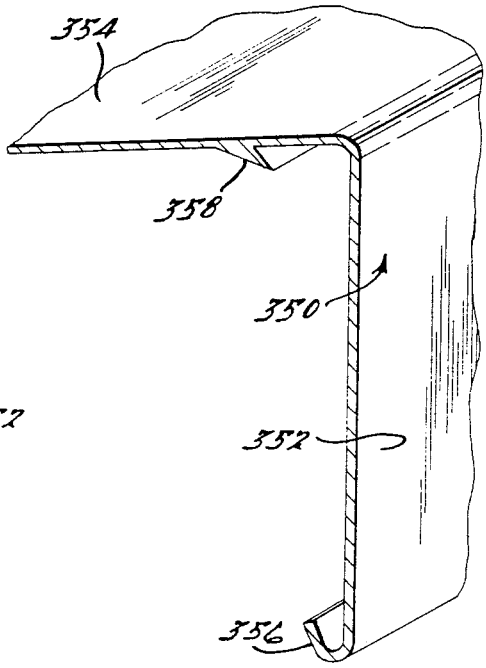
FIG. 4.
FIG. 5.
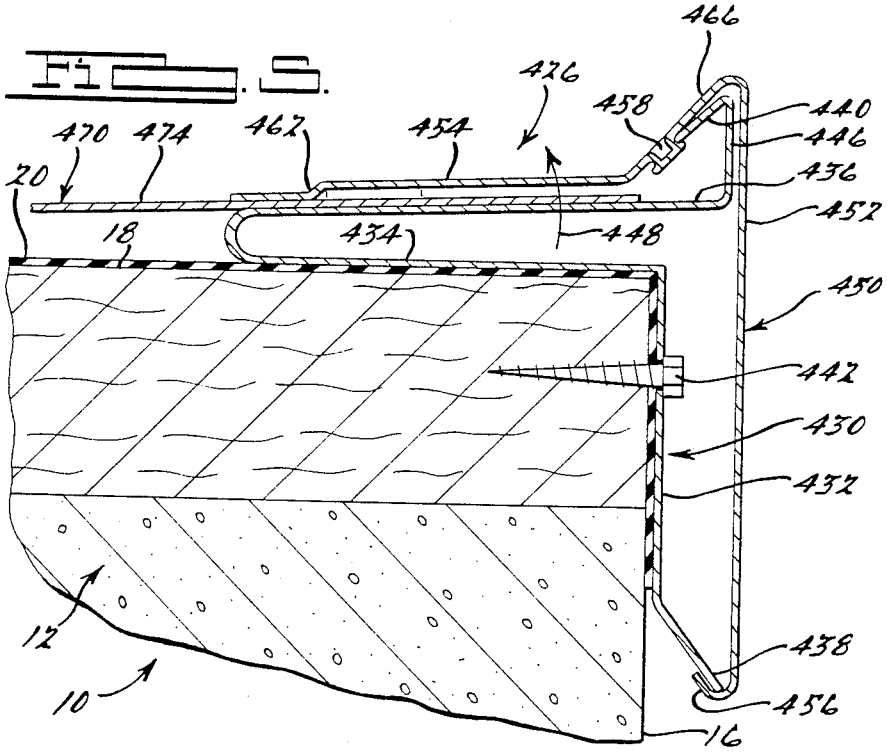

COPING ASSEMBLY FOR A NON-UNIFORM PARAPET WALL

BACKGROUND AND SUMMARY OF THE INVENTION

The invention relates generally to a coping assembly for capping or covering the edge of a building structure wall and, more particularly to such a coping assembly that is adapted to accommodate walls of varying or inconsistent thicknesses.

Frequently a masonry or frame wall, such as a parapet wall extending above the roof line of a building structure, for example must be covered along its upper edge to prevent weather elements from entering through the top or edge of the wall. Such walls are typically finished at the top or edge with coping assemblies, which can consist of masonry constructions, composition constructions, or metal coping assemblies. Such metal coping assemblies have been found to be particularly successful in providing a waterproof cap, as well as an aesthetically pleasing appearance, especially when coupled with a decorative fascia member.

One disadvantage to typical metal coping assemblies is the fact that the coping assembly components must be fabricated off-site and then delivered to the building construction jobsite. However, the walls on which the coping is to be installed are frequently not constructed to exact design widths or thicknesses, or even to consistent widths or thicknesses. In fact, some masonry walls vary as much as three to four inches from the specified design width, and the widths of such walls can also vary considerably along the length of a given wall. Such variations thus require careful field measurements, frequently necessitating that the ordering and specifying of coping materials cannot be done until after the wall is completed, thus causing construction delays and possible premature deterioration of unprotected walls while the building contractor awaits delivery of coping components.

Thus the need has arisen for a coping assembly for a wall, such as a parapet wall, that can accommodate a variety of wall widths, and which can compensate for varying widths along the length of a given wall. The present invention seeks to meet this need by providing a coping assembly for a parapet wall on a building structure that can provide a weather-tight seal while accommodating varying or inconsistent wall widths, with the parapet wall having generally vertical inner and outer vertical surfaces interconnected by a generally horizontal upper surface. Coping assemblies according to the present invention include a preferably resilient clip member, a clip attachment device for attaching the clip member to the vertical outer surface of the parapet wall, a fascia member, a top plate member, and a top plate anchoring device for anchoring the top plate to the vertical inner surface of the parapet wall.

The clip member includes a generally vertical clip leg for overlapping a portion of the vertical outer surface of the parapet wall, a generally horizontal clip leg for overlapping a portion of the horizontal surface of the parapet wall, and a resiliently deflectable sloping clip leg extending transversely to the horizontal clip leg. The vertical clip leg has a lower hooked clip edge thereon, and the sloping clip leg has an upper hooked clip edge thereon.

The fascia member similarly has a generally vertical fascia leg and a generally horizontal fascia leg, with the vertical fascia leg having a lower hooked fascia edge or drip edge thereon for interlockingly engaging the lower hooked clip edge. The generally horizontal fascia leg overlaps at least a portion of the resilient sloping clip leg and has a generally downwardly-directed protrusion thereon for engaging the upper hooked clip edge in a snapped-on relationship after the lower hooked fascia edge and the lower hooked clip edge have been interlockingly engaged with one another.

The top plate member also has a generally vertical plate leg for overlapping a portion of the vertical inner surface of the parapet wall and a generally horizontal plate leg for overlapping a portion of the horizontal surface of the parapet wall. The horizontal plate leg extends outwardly to overlap a portion of the resilient sloping clip leg and to underlap a portion of the horizontal fascial leg such that the horizontal plate leg is resiliently and clampingly engaged therebetween when the fascia member is snapped onto the clip member. This feature allows the coping assembly to accommodate a variety of parapet wall thicknesses or widths between the vertical inner and outer surfaces of the parapet wall, while still substantially preventing the entry of moisture or debris.

A plate anchoring device is also provided for anchoring the vertical plate leg to the vertical inner surface of the parapet wall. Preferably, such plate anchoring is provided by a hold-down member having a generally vertical hold-down leg for overlapping a portion of the vertical inner surface of the parapet wall and a generally horizontal hold-down leg for overlapping a portion of the horizontal surface of the parapet wall. The vertical hold-down leg is disposed between the vertical inner surface of the parapet wall and the vertical plate leg and includes a lower hooked hold-down edge thereon. The vertical plate leg has a lower hooked plate edge or drip edge in this preferred form of the invention for interlockingly engaging the lower hooked hold-down edge. Preferably a fastener is provided for attaching the vertical hold-down leg to the vertical surface of the parapet wall.

Although not essential to the invention in most applications, a sheet-like sealing membrane can be installed in an overlapping relationship with the vertical and horizontal surfaces of the parapet wall, extending either under or over the resilient clip member in order to provide additional rain and condensation protection. As a further option, a sealing member or sealant bead can be provided between the horizontal fascia leg and the horizontal plate leg for even further sealing protection.

Additional objects, advantages, and features of the present invention will become apparent from the following description and appended claims, taken in conjunction with the accompanying drawings.

BRIEF DESCRIPTION OF THE DRAWINGS

FIG. 3 illustrates a further variation on a fascia member of a coping assembly according to the present invention.

FIG. 4 illustrates still another variation on a fascia member for a coping assembly according to the present invention.

FIG. 5 is a partial cross-sectional view, illustrating still another alternate construction of a coping assembly according to the present invention.

DETAILED DESCRIPTION OF THE PREFERRED EMBODIMENTS

Figure 1:
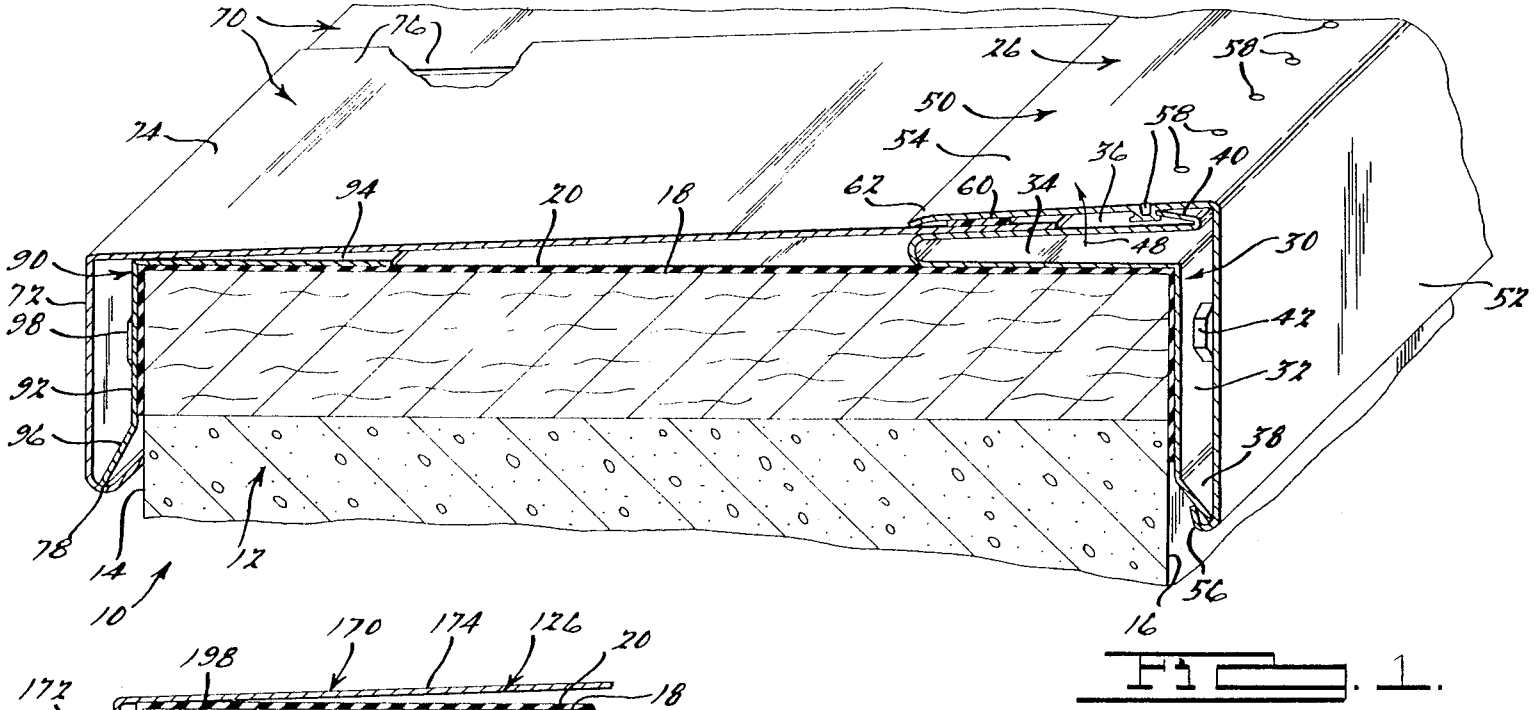
FIG. 1 is a partial perspective view of an exemplary parapet wall having an exemplary preferred form of a coping assembly according to the present invention installed thereon.

FIGS. 1 through 6 illustrate various preferred embodiments of a coping assembly according to the present invention, shown for purposes of illustration in a parapet wall installation. One skilled in the art will readily recognize, however, that the present invention is not restricted to the coping assembly constructions and configurations depicted merely for purposes of illsutration in the drawings, and further is equally applicable to capping applications other than vertical walls or parapet walls for building structures.

FIG. 1 illustrates one preferred embodiment of the present invention, depicting an exemplary application of the invention in a building structure 10 having a generally vertical parapet wall 12 disposed at or adjacent the edge of a roof for the building structure 10. The parapet wall 12 includes a generally vertical inner surface 14 and a generally vertical outer surface 16, with the inner and outer vertical surfaces 14 and 16 being interconnected by a horizontal surface 18. An exemplary coping assembly 26 according to the present invention serves as a covering or cap for the parapet wall 12 in order to prevent the seepage or rain, snow, or condensation onto the top horizontal surface 18 of the parapet wall 12.

The exemplary coping assembly 26 generally includes a resilient clip member 30, a fascia member 50, a top plate member 70, and preferably a hold-down member 90. The clip member 30 has a generally vertical clip leg 32, a generally horizontal clip leg 34, and a generally sloping clip leg 36, which is resiliently deflectable during installation of the fascia member 50 so as to exert a generally upwardly and inwardly-directed resilient biasing force or clamping force indicated diagrammatically by the arrow 48. The vertical clip leg 32 is adapted for overlapping at least a portion of the vertical outer surface 16 of the parapet wall 12 and includes a lower hooked clip edge 38 protruding generally downwardly and outwardly therefrom. The horizontal clip leg 34 is similarly adapted for overlapping at least a portion of the generally horizontal surface 18 of the parapet wall 12, and includes an upper hooked clip edge 40 thereon. An attachment fastener 42, which can be any of a number of well-known conventional fastener devices, is provided for attaching and anchoring the vertical clip leg 32 to the vertical outer surface 16 of the parapet wall 12.

The fasica member 50 includes a generally vertical fascia leg 52, having a lower hooked fascia edge or drip 56 and a generally horizontal fascia leg 54 having a generally downwardly-directed protrusion or discontinuity 58 thereon. The lower hooked fascia edge 56 is adapted for interlockingly engaging the lower hooked clip edge 38, after which the fascia member 50 can be securely snapped onto the resilient clip member 30, with the downwardly-directed protrusion 58 engaging the upper hooked clip edge 40 of the clip member 30. As the fascia member 50 is snapped onto the clip member 30, the resilient sloping clip leg 36 is deflected downwardly until the downwardly-directed protrusion 58 engages the upper hooked clip edge 40, as mentioned above. Preferably, a number of the downwardly-directed protrusions 58 are disposed on the generally horizontal fascia leg 54 for interlockingly engaging the upper hooked clip edge 40 along the length of the fascia member 50, thus assuring a snug fit and retention of the fascia member 50, with the resilient sloping clip leg 36 exerting the above-mentioned resilient biasing or clamping force 48 on the overlapping horizontal fascia leg 54.

The top plate member 70 includes a generally vertical plate leg 72 and a generally horizontal plate leg 74. The horizontal plate leg 74 extends across the top of the parapet wall 12 to overlap a substantial portion of the horizontal surface 18, as well as overlapping a portion of the resilient sloping clip leg 38 and underlapping a portion of the horizontal fascia leg 54 in order to be resiliently and clampingly engaged therebetween when the fascia member 50 is snapped onto the clip member 30.

In the preferred embodiment depicted in FIG. 1, the hold-down member 90 includes a generally vertical hold-down leg 92 and a generally horizontal hold-down leg 94, with the vertical hold-down leg 92 having a hooked hold-down lower edge 96 thereon for interlockingly engaging the hooked plate edge 78 of the top plate member 70. An anchoring fastener 98, which can be any of a number of well-known conventional fastening devices, is provided for anchoring the generally vertical hold-down leg 92 to the vertical inner surface 14 of the parapet wall 12. Thus, by way of the above-mentioned interlocking engagement between the lower hooked hold-down edge 96 and the lower hooked plate edge 78, along with the resilient and clamping engagement of the horizontal plate leg 74 between the resilient sloping clip leg 36 and the horizontal fascia leg 54, the top plate member 70 is securely retained on the parapet wall 12, and thus the coping assembly 26 serves as a cap or cover to protect the parapet wall 12. In this regard, although not felt to be necessary in most applications, an optional sealant member or bead 60 can be provided between the horizontal plate leg 74 and the horizontal fascia leg 54 in order to further minimize the possibility of moisture seepage onto the parapet wall 12. In addition, although it is not deemed to be necessary for the success of the coping assembly 26 in most applications, a sheet-like sealing membrane 20 can be installed in an overlapping relationship with the parapet wall 12, and can sealingly extend between the clip member 30 and the parapet wall 12, as shown in FIG. 1, or alternately can sealingly extend between the clip member 30 and the top plate member 70.

Preferably, adjacent fascia members 50 along the parapet wall 12 are disposed end-to-end in an overlapping relationship with one another, and similarly adjacent top plate members 70 are similarly overlapped, as shown by the overlapping ends 76 in FIG. 1. In addition, the preferred generally horizontal fascia and plate legs 54 and 74, respectively, are sloped slightly downwardly and inwardly for moisture run-off, with the preferred horizontal fascia leg 54 having a sloped inner edge portion 62.

One of the primary advantages of the present invention, which applies equally to all of the embodiments disclosed and described herein, is the provision of the separate fascia member 50 and top plate member 70, with the horizontal plate leg 74 "telescopically" extending a sufficient distance between the clip member 30 and the fascia member 50 such that variations or inconsistencies in the width or thickness of the parapet wall 12 can be accommodated due to the telescoping interrelationship between the top plate member 70 and the fascia member 50, with their horizontal legs 74 and 54, respectively, being in an overlapped relationship. In this regard, width variations among various parapet walls, or width inconsistencies along a given parapet wall, can be accommodated within a predetermined range of such variations or inconsistencies which is generally equal to the amount of overlap between the horizontal fascia leg 54 and the horizontal plate leg 74. Further in this regard, it should be noted that if the parapet wall is too narrow, such that the horizontal plate leg 74 would extend inwardly between the horizontal fascia leg 54 and the sloping clip leg 36 to an extent that it would abut or interfere with the upper hooked clip edge 40, the horizontal plate leg 74 can be field trimmed to an approximately correct width to allow the coping assembly 26 to be assembled generally as shown in FIG. 1.

It should be noted that the generally downwardly-directed, discrete protrusions 58 formed in the horizontal fascis leg 54 shown in FIG. 1 can be any of a number of leak-proof protrusions known to those skilled in the art, with one preferred form of the protrusions 58 being the joint formed by an apparatus marketed under the trademark Tog-L-Loc, and manufactured by BTM Corporation of Marysville, Mich.

Figure 2:
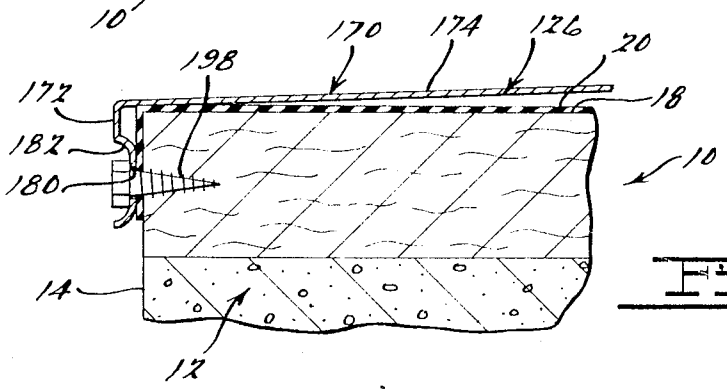
FIG. 2 is a partial cross-sectional view showing a variation on the coping assembly of FIG. 1.

FIG. 2 illustrates an alternate construction of a coping assembly 126 according to the present invention, which is generally similar to the coping assembly 26 described above and illustrated in FIG. 1, except that the hold-down member 90 is eliminated and the top plate member 170 is anchored directly to the vertical inner surface 14 of the parapet wall 12.

The alternate top plate member 170 includes a generally horizontal plate leg 174 and a generally vertical plate leg 172. A recessed portion 182 is formed in the generally vertical plate leg 172, with a fastener opening 180 being provided within the recessed portion 182 for receiving an anchoring fastener 198 in order to anchor the vertical plate leg 172 to the vertical inner surface 14 of the parapet wall 12. In all other respects the coping assembly 126 of FIG. 2 is similar both in function and configuration, to the coping assembly 26 shown in FIG. 1.

FIG. 3 illustrates another variation on the present invention, wherein an alternate fascia member 250 is generally similar, both in function and configuration to the fascia member 50 shown in FIG. 1, with the exception of the provision of one or more generally elongated downwardly-directed protrusions 258 along all or at least a substantial portion of the length of the fascia member 250. The downwardly-directed protrusions 258 can be formed by stamping, punching, or other means well-known to those skilled in the art during the formation of the fascia member 250.

FIG. 4 illustrates still another variation on the present invention, wherein the alternate fascia member 350 is generally similar to the fascia member 250 shown in FIG. 3, except that a generally continuous, downwardly-directed protrusion 358 is formed by molding, extruding, stamping, bending, or other forming methods well-known to those skilled in the art, and results in a generally smooth, or at least generally continuous, upper surface of the horizontal fascia leg 354. In all other respects, the alternate fascia members 250 and 350 of FIGS. 3 and 4, respectively, are similar to the fascia member 50 shown in FIG. 1, both in configuration and function.

A further alternate construction of a coping assembly according to the present invention is illustrated in FIG. 5. In FIG. 5, the alternate coping assembly 426 is generally similar to those described above in the previously-discussed embodiments, except that the clip member 430 includes a generally vertical riser portion 446 between the resilient sloping clip leg 436 and the upper hooked clip edge 440. Similarly, the fascia member 450 includes a somewhat higher vertical fasica leg 452, with a sloping portion 466 formed in the otherwise generally horizontal fascia leg 454, with one or more downwardly-directed protrusions 458 formed in the sloping portion 466 for engaging the upper hooked clip edge 440. It should be noted that the configuration of the downwardly-directed protrusion or protrusions 458 can optionally be that of the discrete protrusions 58 shown in FIGS. 1 or 3, or by the generally continuous protrusion 358 shown in FIG. 4. Such alternate construction, as shown in FIG. 5, can be particularly advantageous or desirable in applications where a higher profile member is desired for aesthetic or other purposes in a given application. In all other respects, the alternate coping assembly 426 is similar in both configuration and function to the previously-discussed exemplary and illustrative embodiments shown in FIGS. 1 through 4.

Figure 6:
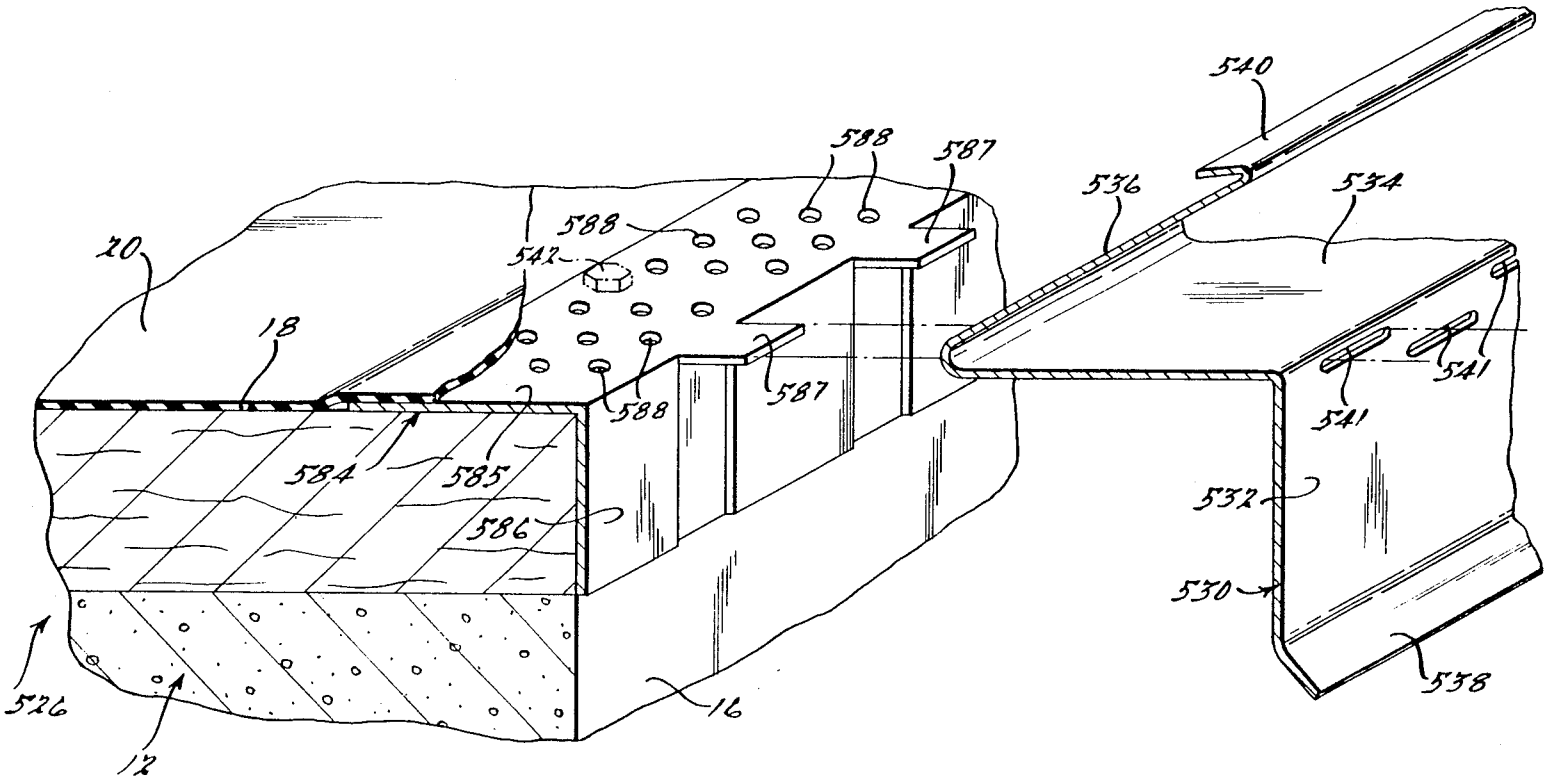
FIG. 6 is a partial perspective view, similar to that of FIG. 1, but illustrating a further alternate embodiment, with an alternate arrangement for securing the resilient clip member to the parapet wall.

Finally, FIG. 6 illustrates still another alternate construction of the present invention, which is also generally similar to those previously discussed. In FIG. 6, however, an alternate, preferably resilient clip member 530 is secured to the parapet wall 12 by way of an intermediate tab strip member 584, having a generally horizontal strip leg 585 and a generally vertical strip leg 586, with a number of tabs 587 formed in an initially outwardly-protruding, generally horizontal configuration.

The clip member 530 corresponding slots 541 formed in its vertical clip leg 532 for receiving the tabs 587, which are then bent or otherwise deformed generally downwardly to interlockingly attach or secure the clip member 530. Prior to inserting the tabs 587 through the slots 541, however, the tab strip member 584 is secured to the parapet wall 12 by way of any of a number of well-known high-strength construction adhesives, with the adhesive penetrating through a plurality of adhesive holes 588 through the horizontal strip leg 585 in order to enhance the strength of the bond. An optional attachment fastener 542 can be employed in lieu of, or in addition to, the construction adhesive in suitable applications where fasteners or anchors can be used on the parapet wall 12.

Tab strip members similar to the tab strip member 584, as well as resilient clips similar to the clip member 530, are disclosed and discussed in detail in U.S. Pat. Nos. 4,472,913 and 4,617,770, both of which are assigned to the same assignee as the present invention and are also incorporated herein by reference. In addition to providing for a speedy and convenient installation, another advantage of such an arrangement is that the installer does not have to lean over the edge of the parapet wall to install an attachment fastener for securing the clip member to the parapet wall. Also, the alternate arrangement of FIG. 6 still allows for the inclusion of the optional sheet-like roofing membrane 20, which can overlie the tab strip member 584, under the clip member 530, similar to the arrangement shown in FIG. 1, except that the membrane 20 would extend only over the vertical strip leg 585 and would be clamped in place by the clip member 530.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A coping assembly for a parapet wall on a building structure, the paratet wall having generally vertical inner and outer surfaces interconnected by a generally horizontal upper surface, said coping assembly comprising:

a clip member having a generally vertical clip leg for overlapping a portion of the vertical outer surface of the parapet wall, a generally horizontal clip leg for overlapping a portion of the horizontal surface of the parapet wall, and a resilently deflectable generally sloping clip leg extending transversely to said horizontal clip leg, said vertical slip leg having a lower hooked clip edge thereon, and said sloping clip leg having an upper hooked clip edge thereon;

clip attachment means for attaching said clip member to the parapet wall;

a fascia member having a generally vertical fascia leg and a generally horizontal fascia leg, said vertical fasica leg having a lower hooked fascia edge thereon for interlockingly engaging said lower hooked clip edge, and said generally horizontal fascia leg overlapping at least a portion of said sloping clip leg and having a generally downwardly-directed protrusion thereon for engaging said upper hooked clip edge in a snapped-on relationship therewidth after said lower hooked fasica edge and said lower hooked clip edge have been interlockingly engaged with one another;

a top plate member having a generally vertical plate leg for overlapping the vertical inner surface of the parapet wall and a generally horizontal plate leg for overlapping a portion of the horizontal surface of the parapet wall, said horizontal plate leg extending outwardly to overlap a portion of said resilient sloping clip leg and to underlap a portion of said horizontal fascia leg and being resiliently clampingly engaged therebetween when said fascia member is snapped onto said clip member in order to accommodate a variety of parapet wall widths between the generally verical inner and outer surfaces thereof; and plate anchoring means for anchoring said top plate member to the parapet wall.

2. A coping assembly according to claim 1, wherein said generally horizontal fascia leg and said generally horizontal clip leg both slope downwardly and inwardly.

3. A coping assembly according to claim 1, wherein said generally horizontal fascia leg and said generally horizontal clip leg both slope downwardly and outwardly.

4. A coping assembly according to claim 1, wherein said generally horizontal fascia leg has a sloped inner edge portion sloping generally downwardly and inwardly.

5. A coping assembly according to claim 1, further including sealant means for sealing between said generally horizontal fascia leg and said generally horizontal clip leg.

6. A coping assembly according to claim 2, wherein the building structure includes a sheet-like membrane extending over the parapet wall, said membrane extending between said clip member and the horizontal surface of the parapet wall.

7. A coping assembly according to claim 1, wherein the building structure includes a sheet-like membrane extending over the parapet wall, said membrane extending between said top plate member and said clip member.

8. A coping assembly according to claim 1, wherein said plate anchoring means includes: a hold-down member having a generally vertical hold-down leg for overlapping a portion of the vertical inner surface of the parapet wall and a generally horizontal hold-down leg for overlapping a portion of the horizontal surface of the parapet wall, said vertical hold-down leg being disposed between the vertical inner surface of the parapet wall and said vertical plate leg and having a hooked hold-down lower edge thereon, said vertical plate leg having a hooked plate lower edge thereon for interlockingly engaging said hooked hold-down lower edge; and hold-down attachment means for attaching said vertical hold-down leg to the vertical surface of the parapet wall.

9. A coping assembly according claim 1, wherein said vertical plate leg has at least one fastener opening extending therethrough, said plate anchoring means including a fastener extending through said fastener opening to attachingly engage the parapet wall.

10. A coping assembly according to claim 9, wherein said vertical plate leg has a generally recessed portion thereon, said fastener opening being disposed within said recessed portion.

11. A coping assembly according to claim 1, wherein said downwardly-directed protrusion includes at least one leak-proof downwardly-directed indentation formed in said generally horizontal fascia leg.

12. A coping assembly according to claim 11, wherein said generally horizontal fascia leg includes a plurality of discrete leak-proof downwardly-directed indentations formed therein and disposed therealong.

13. A coping assembly according to claim 1, wherein said downwardly-directed protrusion includes a downwardly-directed, generally continuous ridge formed along at least a substantial portion of said generally horizontal fascia leg.

14. A coping assembly according to claim 1, including a number of said fascia members serially disposed in a generally end-to-end overlapping relationship along the parapet wall.

15. A coping assembly according to claim 1, including a number of said top plate members serially disposed in a generally end-to-end overlapping relationship along the parapet wall.

16. A coping assembly according to claim 1, including a plurality of said clip members serially disposed generally end-to-end along the parapet wall.

17. A coping member according to claim 1, including a plurality of said clip members serially disposed in a spaced apart relationship along the parapet wall.

18. A coping assembly according to claim 1, wherein said generally horizontal fascia leg includes a generally upwardly and outwardly sloping portion thereof, said downwardly-directed protrusion being formed in said upwardly and outwardly sloping portion.

19. A coping assembly according to claim 1, wherein said clip attachment means includes a tab strip member secured to the parapet wall and having at least one tab protruding therefrom, said clip member having at least one opening therein for receiving said tab extending therethrough, said tab being deformable after being received through said slot in order to interlockingly attach said clip member to said tab strip member.

20. A coping assembly according to claim 19, wherein said tab strip member is secured to the parapet wall by an adhesive means.

21. A coping assembly for a paratpet wall on a building structure, the parapet wall having generally vertical inner and outer surfaces interconnected by a generally horizontal upper surface, said coping assembly comprising:

a clip member having a generally vertical clip leg for overlapping a portion of the vertical outer surface of the parapet wall, a generally horizontal clip leg for overlapping a portion of the horizontal surface of the parapet wall, and a resiliently deflectable generally sloping clip leg extending transversely to said horizontal clip leg, said vertical clip leg having a lower hooked clip edge thereon, and said sloping clip leg having an upper hooked clip edge thereon;

clip attachment means for attaching said clip member to the parapet wall;

a fascia member having a generally vertical fascia leg and a generally horizontal fascia leg, said vertical fascia leg having a lower hooked fascia edge thereon for interlockingly engaging said lower hooked clip edge, and said generally horizontal fascia leg overlapping at least a portion of said sloping clip leg and having a generally downwardly-directed protrusion thereon for engaging said upper hooked clip edge in a snapped-on relationship therewith after said lower hooked fascia edge and said lower hooked clip edge have been interlockingly engaged with one another; said downwardly-directed protrusion including at least one leak-proof downwardly-directed indentation formed in said generally horizontal fascia leg;

a top plate member having a generally vertical plate leg for overlapping the vertical inner surface of the parapet wall and a generally horizontal plate leg for overlapping a portion of the horizontal surface of the parapet wall, said horizontal plate leg extending outwardly to overlap a portion of said resilient sloping clip leg and to underlap a portion of said horizontal fascia leg and being resiliently clampingly engaged therebetween when said fascia member is snapped onto said clip member in order to accommodate a variety of parapet wall widths between the generally vertical inner and outer surfaces thereof; and plate anchoring means for anchoring said top member to the parapet wall, said plate anchoring means including a hold-down member having a generally vertical hold-down leg for overlapping a portion of the vertical inner surface of the parapet wall and a generally horizontal hold-down leg for overlapping a portion of the horizontal surface of the parapet wall, said vertical hold-down leg being disposed between the vertical inner surface of the parapet wall and said vertical plate leg and having a hooked hold-down lower edge thereon, said vertical plate leg having a hooked plate lower edge thereon for interlockingly engaging said hooked hold-down lower edge; and hold-down attachment means for attaching said vertical hold-down leg to the vertical surface of the parapet wall.

22. A coping assembly according to claim 21, wherein at least a portion of said generally horizontal leg slopes generally downwardly.

23. A coping assembly according to claim 21, wherein the building structure includes a sheet-like membrane extending over the parapet wall, said membrane extending between said clip member and the horizontal surface of the parapet wall.

24. A coping assembly according to claim 21, wherein the building structure includes a sheet-like membrane extending over the parapet wall, said membrane extending between said top plate member and said clip member.

25. A coping assembly according to claim 21, wherein said generally horizontal fascia leg includes a plurality of discrete leak-proof downwardly-directed indentations formed therein and disposed therealong.

26. A coping assembly according to claim 21, wherein said downwardly-directed protrusion includes a downwardly-directed, generally continuous ridge formed along at least, a substantial portion of said generally horizontal fascia leg.

27. A coping assembly according to claim 21, wherein said generally horizontal fascia leg includes a generally upwardly and outwardly sloping portion thereof, said downwardly-directed protrusion being formed in said upwardly and outwardly portion.

28. A coping assembly according to claim 21, wherein said clip attachment means includes a tab strip member secured to the parapet wall and having at least one tab protruding therefrom, said clip member having at least one opening therein for receiving said tab extending therethrough, said tab being deformable after being received through said slot in order to interlockingly attach said clip member to said tab strip member.

29. A coping assembly according to claim 28, wherein said tab strip member is secured to the parapet wall by an adhesive means.

30. A coping assembly for a parapet wall on a building structure, the parapet wall having generally vertical inner and outer surfaces interconnected by a generally horizontal upper surface, said coping assembly comprising:

a clip member having a generally vertical clip leg for overlapping a portion of the vertical outer surface of the parapet wall, a generally horizontal clip leg for overlapping a portion of the horizontal surface of the parapet wall, and a resiliently deflectable generally sloping clip leg extending transversely to said horizontal clip leg, said vertical clip leg having a lower hooked clip edge thereon, and said sloping clip leg having an upper hooked clip edge thereon;

clip attachment means for attaching clip member to the parapet wall;

a fascia member having a generally vertical fascia leg and a generally horizontal fasica leg, said vertical fascia leg having a lower hooked fascia edge thereon for interlockingly engaging said lower hooked clip edge, and said generally horizontal fascia leg overlapping at least a portion of said sloping clip leg and having a generally downwardly-directed protrusion thereon for engaging said upper hooked clip edge in a snapped-on relationship therewith after said lower hooked fascia edge and said lower hooked clip edge have been interlockingly engaged with one another, said downwardly-directed protrusion including at least one leak-proof downwardly-directed indentation formed in said generally horizontal fascia leg;

a top plate member having a generally vertical plate leg for overlapping the vertical inner surface of the parapet wall and a generally horizontal plate leg for overlapping a portion of the horizontal surface of the parapet wall, said horizontal plate leg extending outwardly to overlap a portion of said resilient sloping clip leg and to underlap a portion of said horizontal fascia leg and being resiliently clampingly engaged therebetween when said fascia member is snapped onto said clip member in order to accommodate a variety of parapet wall widths between the generally vertical inner and outer surfaces thereof; and plate anchoring means including a fastener for anchoring said vertical plate leg to the vertical inner surface of the parapet wall.

31. A coping assembly according to claim 30, wherein at least a portion of said generally horizontal leg slopes generally downwardly.

32. A coping assembly according to claim 30, wherein the building structure includes a sheet-like membrane extending over the parapet wall, said membrane extending between said clip member and the horizontal surface of the parapet wall.

33. A coping assembly according to claim 30, wherein the building structure includes a sheet-like membrane extending over the parapet wall, said membrane extending betwen said top plate member and said clip member.

34. A coping assembly according to claim 30, wherein said generally horizontal fascia leg includes a plurality of discrete leak-proof downwardly-directed indentations formed therein and disposed therealong.

35. A coping assembly according to claim 30, wherein said downwardly-directed protrusion includes a downwardly-directed, generally continuous ridge formed along at least a substantial portion of said generally horizontal fascia leg.

36. A coping assembly according to claim 30, wherein said vertical plate leg has a generally recessed portion thereon, said fastener opening being disposed within said recessed portion.

37. A coping assembly according to claim 30, wherein said clip attachment means includes a tab strip member secured to the parapet wall and having at least one tab protruding therefrom, said clip member having at least one opening therein for receiving said tab extending therethrough, said tab being deformable after being received through said slot in order to interlockingly attach said clip member to said tab strip member.

38. A coping assembly according to claim 37, wherein said tab strip member is secured to the parapet wall by an adhesive means.

* * * * *

UNITED STATES PATENT AND TRADEMARK OFFICE

CERTIFICATE OF CORRECTION

PATENT NO. : 4,964,248

DATED : October 23, 1990

INVENTOR(S) : Braine, et al

It is certified that error appears in the above-identified patent and that said Letters Patent is hereby corrected as shown below:

Column 3, line 21, "illsutration" should be --illustration--.

Column 4, line 19, "38" should be --36--.

Column 5, line 26, "fascis" should be --fascia--.

Column 6, line 25, after "profile" insert --fascia--.

Column 6, line 40, after "530" insert --has--.

Column 7, line 15, Claim 1, "paratet" should be --parapet--.

Column 7, line 23, Claim 1, "resilently" should be --resiliently--.

Column 7, line 25, Claim 1, "slip" should be --clip--.

Column 7, line 39, Claim 1, "therewidth" should be --therewith--.

Column 8, line 5, Claim 6, "2" should be --1--.

Column 9, line 14, Claim 21, "paratpet" should be --parapet--.

Column 9, line 58, Claim 21, after "top" insert --plate--.

Column 10, lines 19-20, Claim 25, "whereins" should be --wherein--.

UNITED STATES PATENT AND TRADEMARK OFFICE

CERTIFICATE OF CORRECTION

PATENT NO. : 4,964,248

DATED : October 23, 1990

INVENTOR(S) : Braine, et al

It is certified that error appears in the above-identified patent and that said Letters Patent is hereby corrected as shown below:

Column 10, line 32, Claim 27, after "outwardly" insert --sloping--.

Column 12, line 4, Claim 33, "betwen" should be --between--.

Signed and Sealed this

Eleventh Day of February, 1992

*Attest:*

HARRY F. MANBECK, JR.

*Attesting Officer*

*Commissioner of Patents and Trademarks*